United States Patent [19]

Guinn

[11] Patent Number: 4,604,068

[45] Date of Patent: Aug. 5, 1986

[54] MARINE PROPULSION DEVICE LOWER UNIT INCLUDING PROPELLER BEARING MEMBER ANODE

[75] Inventor: Douglas B. Guinn, Shorewood, Wis.

[73] Assignee: Outboard Marine Corporation, Waukegan, Ill.

[21] Appl. No.: 648,575

[22] Filed: Sep. 10, 1984

[51] Int. Cl.[4] ..... B63H 1/00

[52] U.S. Cl. ..... 440/76; 440/78; 440/900; 416/146 R; 204/147; 204/196

[58] Field of Search ..... 440/49, 76, 78, 900; 204/196, 197, 147, 148; 416/93 A, 93 M, 134 R, 247 A, 244 B, 146 R; 74/417

[56] References Cited

U.S. PATENT DOCUMENTS

| | | | |
|---|---|---|---|
| 2,067,839 | 1/1937 | Godfrey | 204/197 |
| 3,169,504 | 4/1973 | Gruber | 204/197 |
| 3,240,180 | 3/1966 | Byrd | 440/78 |
| 3,726,779 | 4/1973 | Morgan | 204/197 |
| 3,937,093 | 2/1976 | Johnson et al. | 74/417 |
| 4,146,448 | 3/1979 | Nakano et al. | 204/148 |
| 4,391,567 | 7/1983 | Ciampolillo | 416/146 R |

*Primary Examiner*—Sherman D. Basinger
*Assistant Examiner*—Edwin L. Swinehart
*Attorney, Agent, or Firm*—Michael, Best & Friedrich

[57] ABSTRACT

A lower unit for a marine propulsion device, which lower unit comprises a drive shaft housing having a lower end, a gear case housing connected to the lower end of the drive shaft housing, a propeller shaft located in and extending axially through the gear case housing, a member for rotatably supporting the propeller shaft inside the gear case housing, which member is located in the gear case housing, which is in encircling relationship to the propeller shaft, and which includes therein an open area in communication with the environment outside of the gear case housing, a sacrificial anode in the open area, and a fastener for releasably securing the sacrificial anode in the open area.

11 Claims, 5 Drawing Figures

MARINE PROPULSION DEVICE LOWER UNIT INCLUDING PROPELLER BEARING MEMBER ANODE

BACKGROUND OF THE INVENTION

This invention relates generally to lower units for marine propulsion devices, such as outboard motors and stern drive units, and, more particularly, to anodes attached to marine propulsion devices to provide protection against corrosion resulting from galvanic action.

Attention is directed to Cavil, pending U.S. application Ser. No. 365,295, filed Apr. 5, 1982, which discloses a marine propulsion device including a thrust bushing anode, and to Byrd, U.S. Pat. No. 3,240,180, issued Mar. 15, 1966, which discloses a marine propulsion device including a lower portion including therein a chamber, and a body of electrolytically susceptible material contained within the chamber. Attention is also directed to Johnson et al., U.S. Pat. No. 3,937,093, issued Feb. 10, 1976, which is hereinafter incorporated by reference.

SUMMARY OF THE INVENTION

The invention provides a lower unit for a marine propulsion device, which lower unit comprises a lower portion, an open area inside the lower portion, an opening located in the lower portion communicating the open area with the environment outside of the lower portion, a sacrificial anode passable through the opening, and means operably accessible from the outside of the lower portion for releasably securing the sacrificial anode in the open area after the passage of the sacrificial anode through the opening.

This invention also provides a lower unit for a marine propulsion device, which lower unit comprises a drive shaft housing having a lower end, a gear case housing connected to the lower end of the drive shaft housing, a propeller shaft located in and extending axially through the gear case housing, means for rotatably supporting the propeller shaft inside the gear case housing and including a member which is located in the gear case housing, which is in encirclng relationship to the propeller shaft, and which includes therein an open area in communication with the environment outside of the gear case housing, a sacrificial anode in the open area, and means for releasably securing the sacrificial anode in the open area.

In one embodiment, the gear case housing has an interior wall defining an elongated cavity, and the wall includes an upper opening to an exhaust passage, and the member includes a first side adjacent the upper opening, and a second side diametrically opposite the first side, and the open area is defined by the second side and a portion of the interior wall.

One of the principal features of the invention is the provision of a lower unit for a marine propulsion device, which lower unit includes a sacrificial anode which is easily replaceable without disassembling a bearing carrier member from a gear case housing.

Another of the principal features of the invention is the provision of a sacrificial anode which provides corrosion protection in close proximity to a gear case assembly in a lower unit of a marine propulsion device, but which avoids adversely affecting exhaust flow through the gear case housing.

Another of the principal features of the invention is the provision of corrosion protection means which does not adversely affect the flow of water around a lower unit of a marine propulsion device.

Various other features and advantages of the invention will become apparent upon reviewing the following detailed description, the drawings and the appended claims.

Figure 1:
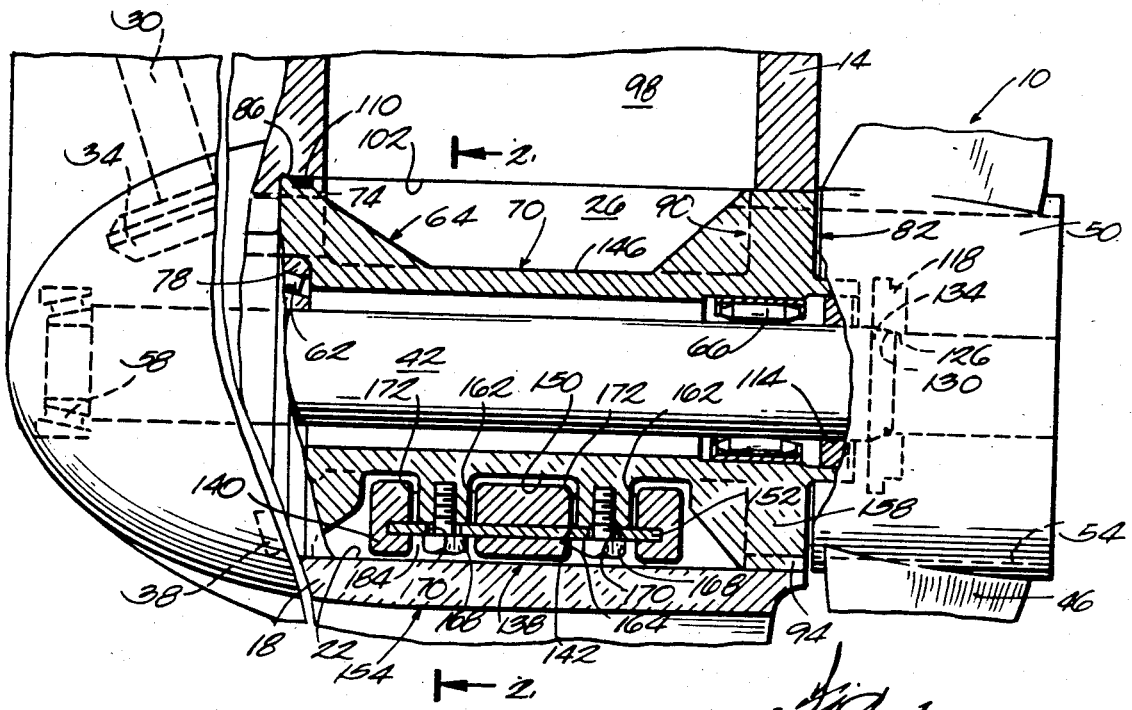
FIG. 1 is a partially schematic, fragmentary, and partially sectioned view, of a lower unit of a marine propulsion device embodying various of the features of the invention.

Before explaining the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

DESCRIPTION OF PREFERRED EMBODIMENTS

Illustrated in the drawings, and referring particularly to FIG. 1, is a lower unit 10 of a marine propulsion device, such as an outboard motor or a stern drive unit. The lower unit 10 is supported from a boat (not shown) in the normal manner for horizontal steering movement and vertical tilting movement. The lower unit 10 has a drive shaft housing 14, and a gear case housing 18 which is connected to the lower end of the drive shaft housing 14 and which includes an interior wall 22 defining an elongated, generally cylindrical cavity 26.

Rotatably supported within the drive shaft housing 14 and operably connected to a suitable source of power, such as an engine, is a schematically illustrated drive shaft 30 carrying a beveled pinion gear 34. The pinion gear 34 meshes with a drive gear 38 mounted on a propeller shaft 42 to drive a propeller 46 (shown fragmentarily) carried on the rear or aft end of the propeller shaft 42. The propeller 46 can have a hub 50 with an axial passage 54 to afford underwater discharge of exhaust gases. The invention is not limited to a hub exhaust arrangement.

The propeller shaft 42 is axially centered in the gear case cavity 26 and is therein rotatably supported by a first thrust bearing 58 suitably mounted in the forward portion of the gear case housing 18, a second thrust bearing 62 located adjacent the drive gear 38 and carried by a bearing carrier member 64, and a needle bearing 66 supported by the bearing carrier member 64. The bearing carrier member 64 is of a spool-like construction and generally encircles the propeller shaft 42. The bearing carrier member 64 includes a generally cylindrical sleeve portion 70, an annular forward portion 74 connected to the forward end of the sleeve portion 70 and having a generally cylindrical nose portion 78 adapted to carry the second thrust bearing 62, and a spider portion 82 (see also FIG. 5) connected to the rear or aft end of the sleeve portion 70. The forward portion 74 has a generally circular outer peripheral surface 86 which fits snuggly against the interior wall 22 of the gear case housing 18. The spider portion 82 has a plurality of circumferentially spaced radially extending legs 90 which at the outer ends thereof carry a ring 94 (see also FIG. 5) which also fits snuggly against the interior wall 22 of the gear case housing 18.

Provided in the drive shaft housing 14 for exhausting the exhaust gas from the engine into the water is an exhaust passage 98 which communicates with the gear case cavity 26 through an upper opening 102 in the wall 22 of the gear case housing 18. Exhaust gases exit rearwardly from the gear case cavity 26 through a plurality of openings 106 (see FIG. 5) formed between the spider portion legs 90 and are discharged into the water through the hub passage 54.

Water and exhaust gases are prevented from reaching the first and second bearings 58 and 62, respectively, the needle bearing 66, and the pinion and drive gears 34 and 38, respectively, by an O-ring 110 disposed in sealing engagement between the forward portion 74 of the bearing carrier member 64 and the interior wall 22 of the gear case housing 18, and an annular sealing member 114 disposed in sealing engagement between the propeller shaft 42 and the spider portion 82 of the bearing carrier member 64.

To prevent axial displacement of the propeller shaft 42 relative to the gear case housing 18, means (not shown) is provided for removably anchoring the bearing carrier member 64 to the interior wall 22 of the gear case housing 18. Any suitable anchoring means can be used, such as the anchoring means described in Johnson et al., U.S. Pat. No. 3,937,093, issued Feb. 10, 1976, which is incorporated herein by reference.

Forward propeller thrust is transmitted from the propeller 46 to the propeller shaft 42 through a thrust bushing 118. More particularly, the thrust bushing 118 includes a central or hub portion which has an aperture 126 permitting passage therethrough of the propeller shaft 42, which aperture 126 is defined, in part, by a thrust transmitting surface 130 which engages a thrust receiving part 134 of the propeller shaft 42 for transmission of forward thrust from the thrust bushing 118 to the propeller shaft 42.

In a preferred construction, the lower gear case housing 18 and the bearing carrier member 64 are fabricated from a material such as aluminum or other metal. Since these parts are in close proximity to the propeller shaft 42 and the thrust bushing 118, which are each preferrable fabricated from stainless steel, the gear case housing 18 and the bearing carrier member 64 are each likely to corrode due to galvanic action when the lower unit 10 of the marine propulsion device is operated in saltwater.

The galvanic action occurs where metallic parts formed from two different metals, such as steel and aluminum, are immersed in an electrolyte such as seawater. In the lower unit 10 of a marine propulsion device, as shown in FIG. 1, where the propeller shaft 42 and thrust bushing 118 are fabricated from stainless steel, these parts form a cathode. Adjacent structures formed from metals such as zinc or aluminum will function as an anode. Close proximity of the anodic and cathodic parts will result in rapid dissolution of the anodic part. Since the lower gear case housing 18 and the bearing carrier member 64 are constructed of aluminum, those portions of the gear case housing 18 and the bearing carrier member 64 immersed in saltwater and adjacent the thrust bushing 118 and the propeller shaft 42 will tend to function as anodes and to corrode rapidly.

Means is provided for reducing the tendency of the rearward part of the gear case housing 18 and the bearing carrier member 64 to corrode due to galvanic action. This means is in the form of a sacrificial anode 138 fabricated from a suitable metal or alloy of the type which provides protection of the gear case housing 18 and the bearing carrier member 64 from galvanic couples caused by the presence of the dissimilar metals in the electrolyte. In the illustrated embodiments, the sacrificial anode 138 is made of an anode material 140, such as zinc, mounted on an insert 142 fabricated from a more noble material, such as aluminum alloy. The insert 142 supports the sacrificial anode material 140 as it corrodes.

In the operation of the sacrificial anode 138, when the propeller shaft 42 and the thrust bushing 118 are submersed in the electrolyte and function as cathodes, the sacrificial anode material 140 will corrode rather than the gear case housing 18 or the bearing carrier member 64.

Galvanic corrosion of the bearing carrier member 64 can have a particularly adverse effect. Such corrosion can result in the failure of the fluid-tight seal between the sealing member 114 and the internal bore of the bearing carrier member 64. Failure of the sealing member 114 can result in a leakage of water into the gear case housing 18 and contamination of the lubricant therein and eventual failure of the gears in the gear case housing 18. Accordingly, it is particularly important that corrosion of the bearing carrier member 64 be controlled.

When the bearing carrier member 64 is mounted in the gear case housing cavity 26, the sleeve portion 70 of the bearing carrier member 64 includes a first side 146 adjacent the upper opening 102 in communication with the exhaust passage 98, and a second side 150 diametrically opposite the first side 146.

While other constructions can be employed in other embodiments, and still include some of the features of the invention, the preferred location of the sacrificial anode 138 is on the second side 150 of the sleeve portion 70 so that the anode 138 is not in the direct flow path of exhaust gases through the gear case housing cavity 26. As a result, corrosion of the anode material 140 by flowing exhaust is minimized and the sacrificial anode 138 does not restrict the exhaust.

Figure 3:
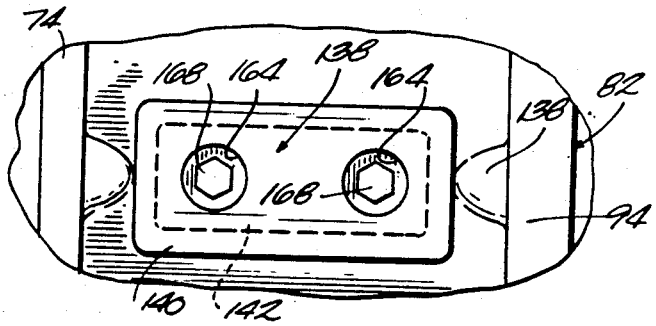
FIG. 3 is a lower side view of a sacrificial anode attached to a bearing carrier member, as illustrated in FIG. 1.
Figure 2:
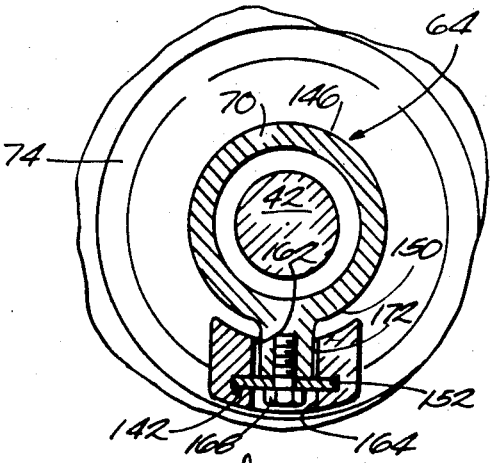
FIG. 2 is a sectional view taken along the line 2—2 in FIG. 1.

In a first embodiment, illustrated in FIGS. 1 through 3, the insert 142 comprises an aluminum alloy plate 152 to which the sacrificial anode material 140 is secured.

Means 154 is also provided for releasably securing the sacrificial anode 138 between one 158 of the legs 90 of the spider portion 82 and the annular forward portion 74 of the bearing carrier member 64. In this regard, the sacrificial anode material 140 includes two spaced-apart pairs of first and second openings 162 and 164, respectively, on the opposite sides of the plate 152. The releasable securing means 154 includes a pair of fasteners or retaining screws 168 received in bores 170 in the plate 152 and centered in the openings 162 and 164 in the sacrificial anode material 140. The retaining screws 168 are received in two spaced-apart projections 172 which fixedly extend from the second side 150 of the sleeve portion 70 of the bearing carrier member 64 and which are positioned within the first opening 162 in the sacrificial anode material 140.

The sacrificial anode 138 must be replaced periodically and should, therefore, be easily accessible for replacement. The sacrifical anode 138 is easily replacable in the first embodiment by removing the bearing carrier member 64 from the gear case housing 18, and then removing the retaining screws 168 from the projections 172. The old sacrificial anode 138 can then be replaced with a new one, the screws 168 secured to the projections 172, and the bearing carrier member 64 reinstalled in the gear case cavity 26.

As illustrated in FIGS. 1 and 3, the sacrificial anode 138 substantially fills the space between the one leg 158 of the spider portion 82 and the annular forward portion 74 of the bearing carrier member 64. While other constructions can be used in other embodiments, the sacrificial anode 138 is curved to conform to the curved surface of the sleeve portion 70, and, the sacrificial anode 138 is spaced from the sleeve portion 70 (See FIG. 2). As illustrated in FIG. 2, the width of the sacrificial anode 138 is slightly less than the diameter of the sleeve portion 70 of the bearing carrier member 64 so interference is minimized between the sacrificial anode 138 and the flow of exhaust gases around the bearing carrier member 64 and through the exhaust housing cavity 26.

Figure 4:
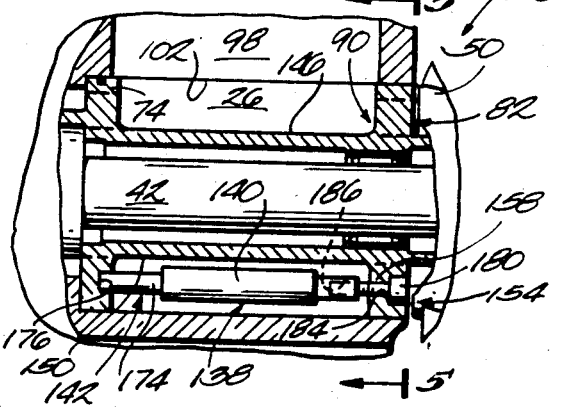
FIG. 4 is a fragmentary, partially sectioned view, of an alternate arrangement of a lower unit of a marine propulsion device embodying various of the features of the invention.
Figure 5:
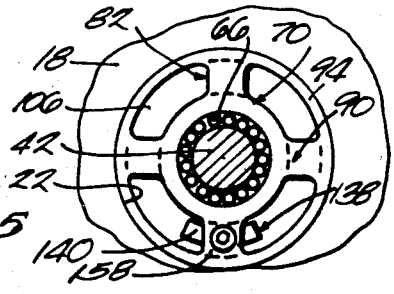
FIG. 5 is a perspective view, partially in cross-section, taken along the line 5—5 in FIG. 4.

In another embodiment 173, as illustrated in FIGS. 4 and 5, the insert 142 comprises an aluminum alloy rod 174 to which the sacrificial anode material 140 is mounted. The means 154 for releasably securing the sacrificial anode 138 between the one leg 158 of the spider portion 82 and the annular forward portion 74 of the bearing carrier member 64 includes receipt of one end of the rod 174 in an opening 176 in the forward portion 74 of the bearing carrier member 64, and a screw 180 received in an aperture 184 in the one leg 158 of the spider portion 82, which screw 180 is secured in a threaded bore 186 in the other end of the rod 174. The sacrificial anode 138 substantially fills the space between the one leg 158 of the spider portion 82 and the annular forward portion 74 of the bearing carrier member 64, and has a transverse cross section (See FIG. 5) slightly smaller than the size of one of the openings 106 between the legs 90 of the spider portion 82 so the anode 138 can pass through one of the openings 106.

In the second embodiment 173, the anode 138 is secured to and installed in the bearing carrier member 64 in the following manner. The anode 138 is inserted through one of the openings 106 between the legs 90 of the spider portion 82. The forward end of the rod 174 is secured in the opening 176 in the forward portion 74 of the bearing carrier member 64, and the aft end is retained by the screw 180 received in the aperture 184 in the leg 158 of the spider portion 82. As a result of this construction, the sacrificial anode 138 can be secured on the second side 150 of the bearing carrier member 64 when the bearing carrier member 64 is in the gear case housing 18, and, likewise, can be removed from the gear case housing 18 and disconnected from the bearing carrier member 64 while the bearing carrier member 64 is still secured inside the gear case housing 18. This capability greatly simplifies the replacement of the sacrificial anode 138 by eliminating the need to remove the bearing carrier member 64.

Various of the features of the invention are set forth in the following claims.

I claim:

1. A lower unit for a marine propulsion device, which lower unit comprises a lower portion, an open area inside said lower portion, an opening located in said lower portion and communicating said open area with the environment outside of said lower portion, a sacrificial anode passable through said opening, and means operably accessible from outside of said lower portion for releasably securing said sacrificial anode in said open area after the passage of said sacrificial anode through said opening.

2. A lower unit for a marine propulsion device in accordance with claim 1 wherein said sacrificial anode includes a rod, and wherein said securing means comprises means securing said rod to said lower portion.

3. A lower unit for a marine propulsion device, which lower unit comprises a drive shaft housing having a lower end, a gear case housing extending from said lower end of said drive shaft housing and including a cavity having an open rearward end, a propeller shaft located in and extending axially through said cavity in said gear case housing and out said rearward end, means for rotatably supporting said propeller shaft inside said gear case housing and including a member which is located in said cavity in said gear case housing and in encircling relation to said propeller shaft, a sacrificial anode in said cavity, and means for releasably securing said sacrificial anode to said member.

4. A lower unit for a marine propulsion device, which lower unit comprises a drive shaft housing having a lower end, a gear case housing connected to said lower end of said drive shaft housing, a propeller shaft located in and extending axially through said gear case housing, means for rotatably supporting said propeller shaft inside said gear case housing and including a member which is located in said gear case housing, which is in encircling relation to said propeller shaft, and which includes therein an open area in communication with the environment outside of said gear case housing, said member further including an opening to said open area, a sacrificial anode in said open area, said sacrificial anode being passable through said opening, and means for releasably securing said sacrificial anode in said open area, said securing means being operably accessible from outside of said gear case housing after passage of said sacrificial anode through said opening.

5. A lower unit for a marine propulsion device in accordance with claim 4 wherein said gear case housing has an interior wall defining an elongated cavity, wherein said propeller shaft is located in and extends axially through said gear case housing cavity, and wherein said member is supported from said interior wall of said gear case housing.

6. A lower unit for a marine propulsion device, which lower unit comprises a drive shaft housing having a lower end, a gear case housing connected to said lower end of said drive shaft housing, a propeller shaft located in and extending axially through said gear case housing, means for rotatably supporting said propeller shaft inside said gear case housing and including a member which is located in said gear case housing, which is in encircling relation to said propeller shaft, and which includes therein an open area in communication with the environment outside of said gear case housing, a sacrificial anode in said open area, said sacrificial anode including an opening therein, and means for releasably securing said sacrificial anode in said open area and comprising a projection fixedly extending from said member, and a fastener received in said sacrificial anode opening and secured to said projection.

7. A lower unit for a marine propulsion device, which lower unit comprises a drive shaft housing having a lower end and including an exhaust passage, a gear case housing extending from said lower end of said drive shaft housing and having an interior wall defining an elongated cavity, said wall including an upper opening to said exhaust passage and a rearward opening to the environment outside of said gear case housing, a propeller shaft, means for rotatably supporting said propeller shaft inside said gear case housing cavity and including a member which is in encircling relation to said propeller shaft, which is attached to said interior wall of said gear case housing, and which includes therein an open area in communication with said exhaust passage and the environment outside of said gear case housing, a sacrificial anode in said open area, and means for releasably securing said sacrificial anode in said open area.

8. A lower unit for a marine propulsion device in accordance with claim 7 wherein said member includes a first side adjacent said upper opening and a second side diametrically opposite said first side, and wherein said open area is defined by said second side and a portion of said interior wall.

9. A lower unit for a marine propulsion device in accordance with claim 7 wherein said member further includes an opening to said open area, and wherein said sacrificial anode is passable through said opening, and wherein said securing means is operably accessible from outside of said gear case housing after passage of said sacrificial anode through said opening.

10. A lower unit for a marine propulsion device, which lower unit comprises a drive shaft housing having a lower end and including an exhaust passage, a gear case housing connected to said lower end of said drive shaft housing and having an interior wall defining an elongated cavity, said wall including an upper opening to said exhaust passage and a rearward opening to the environment outside of said gear case housing, a propeller shaft, means for rotatably supporting said propeller shaft inside said gear case housing cavity and including a bearing carrier member which is in encircling relation to said propeller shaft, which is attached to said interior wall of said gear case housing, which carries a bearing rotatably engaging said propeller shaft, and which includes a generally cylindrical sleeve portion including a forward end and a rear end, a forward portion connected to said forward end of said sleeve portion and in engagement with said interior wall, and a spider portion connected to said rear end of said sleeve portion and including a plurality of circumferentially spaced radially extending legs having ends in engagement with said interior wall, one of said legs including therein an opening, and wherein said exhaust passage is in communication through said upper opening, around said sleeve portion, and through said circumferentially spaced legs, with the environment outside of said gear case housing, a sacrificial anode including a rod, and means for releasably securing said sacrificial anode between said one of said legs and said forward portion, said securing means comprising means securing said rod in said opening.

11. A lower unit for a marine propulsion device in accordance with claim 10, wherein said sleeve portion includes a first side adjacent said upper opening and a second side diametrically opposite said first side, and wherein said sacrificial anode is located adjacent said second side of said sleeve portion.

* * * * *